US006293345B1

(12) United States Patent
Watkins

(10) Patent No.: US 6,293,345 B1
(45) Date of Patent: Sep. 25, 2001

(54) APPARATUS FOR SUBSEA WELLS INCLUDING VALVE PASSAGEWAY IN THE WALL OF THE WELLHEAD HOUSING FOR ACCESS TO THE ANNULUS

(75) Inventor: Bruce J. Watkins, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 09/048,614

(22) Filed: Mar. 26, 1998

(51) Int. Cl.[7] ..... E21B 34/04
(52) U.S. Cl. ..... 166/368; 166/345; 166/360
(58) Field of Search ..... 166/363, 367, 166/368, 345, 348, 360

(56) References Cited

U.S. PATENT DOCUMENTS

| | | | | |
|---|---|---|---|---|
| 4,632,188 | * | 12/1986 | Schuh et al. | 166/368 |
| 4,726,424 | * | 2/1988 | Raulins | 166/338 |
| 5,143,158 | | 9/1992 | Watkins et al. | 166/344 |
| 5,213,162 | * | 5/1993 | Iato | 166/341 |
| 5,280,766 | * | 1/1994 | Mohn | 166/368 |
| 5,544,707 | * | 8/1996 | Hopper et al. | 166/382 |
| 5,687,794 | | 11/1997 | Watkins et al. | 166/363 |
| 5,735,344 | | 4/1998 | Duncan | 166/75.14 |

FOREIGN PATENT DOCUMENTS

| | | |
|---|---|---|
| 0373766A2 | 6/1990 | (EP) . |
| 2291085A | 1/1996 | (GB) . |

* cited by examiner

*Primary Examiner*—David Bagnell
*Assistant Examiner*—John Kreck
(74) *Attorney, Agent, or Firm*—Browning Bushman P.C.

(57) ABSTRACT

Apparatus is disclosed for use in drilling and completing a subsea well of the type in which a blowout preventer stack positioned on a floating rig is connected to the well by a drilling riser, and wherein the flow of well fluid between the tubing/casing annulus and the upper end of the wellhead is controlled by valves means within passageway in a relatively thick walled upper portion of the housing above a relatively thin walled portion thereof in which a casing hanger is installed.

9 Claims, 10 Drawing Sheets

Figure 1:
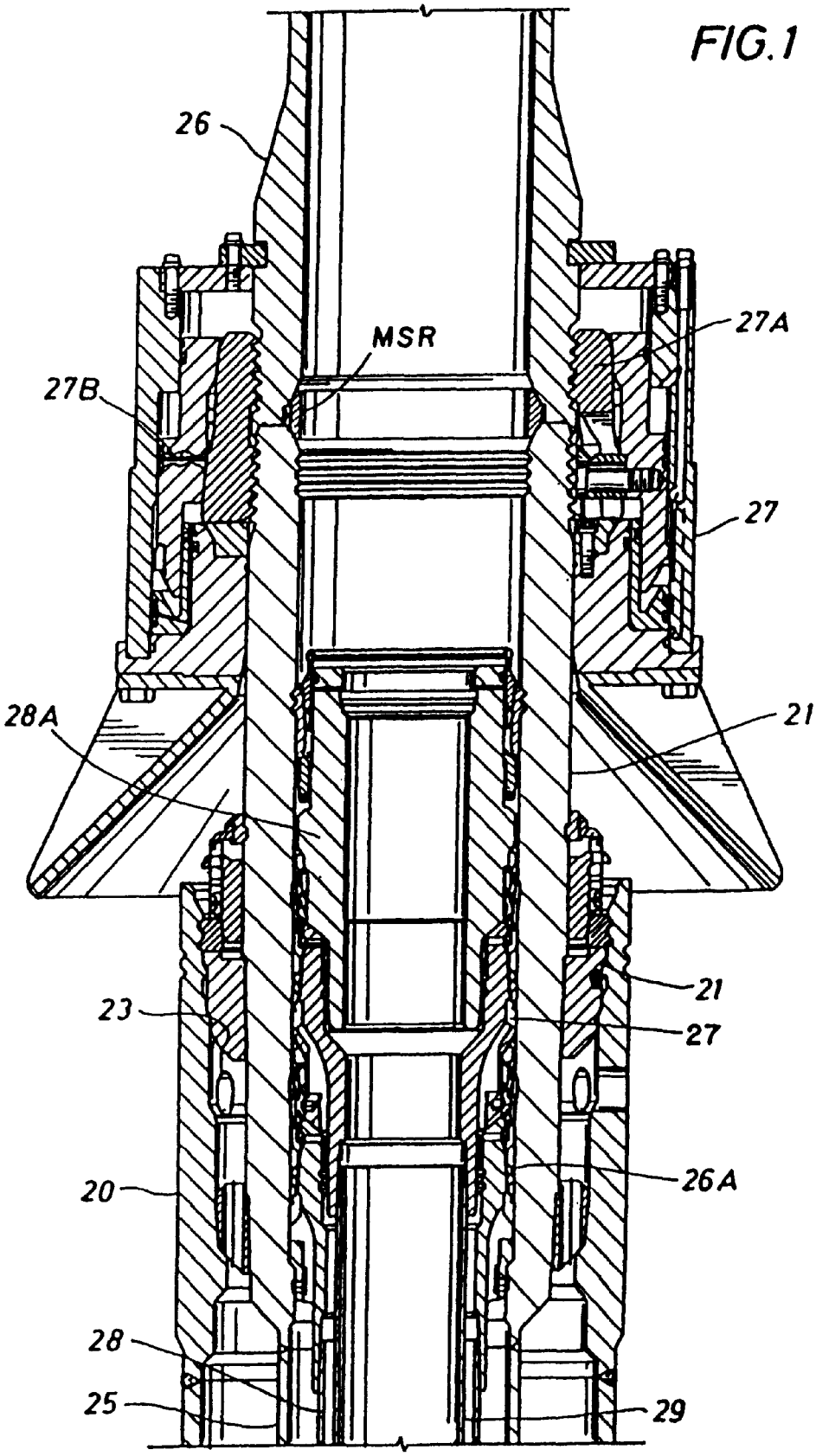

26
MSR
27A
27B
27
28A
21
21
23
27
26A
20
28
25
29

APPARATUS FOR SUBSEA WELLS INCLUDING VALVE PASSAGEWAY IN THE WALL OF THE WELLHEAD HOUSING FOR ACCESS TO THE ANNULUS

This invention relates generally to apparatus for use in drilling and completing subsea wells of the type in which a blowout preventer (BOP) stack is positioned on a floating rig and is connected to the head of the well by a high pressure riser. More particularly, it relates to improvements in apparatus of this type in which the flow of well fluid between the tubing/casing annulus within the well and equipment above the wellhead is controlled by valve means within passageway means in the wellhead, and, if desired, in which operating fluid to or from a downhole function, such as a tubing safety valve, flows through a passageway means connecting to a subsea Christmas tree or a production riser connector leading to a surface tree.

In apparatus of the type in which the Christmas tree is installed on the wellhead so as to produce the well at the subsea level, flow between the tubing/casing annulus and the tree is typically controlled by an "annulus safety valve" installed in passageway means in a tubing hanger suspended within the wellhead housing. See, for example, U.S. Pat. Nos. 5,143,158 and 5,687,794, both assigned to the Assignee of the present Application. Other downhole functions, such as opening or closing subsurface tubing safety valves, are often controlled by operating fluid transmitted to or exhausted from the valves or other functions through additional passageways within the tubing hanger.

In the drilling and completion of a subsea well of the type contemplated by this invention, a relatively large diameter, low pressure drilling riser is normally used in the early drilling stages, and a relatively small diameter, high pressure production riser is used during the installation of production casing and/or production tubing, the use of smaller diameter risers of course reducing costs. This could perhaps be accomplished with a single wellhead housing, without resort to large diameter production risers, by landing a small diameter production tubing hanger in a sleeve installed within the bore of the wellhead housing. However, because of physical restraints, it would be impossible to control the flow of well fluid in the annulus or the flow of control or operating fluid through the tubing hanger.

In accordance with the novel aspects of the present invention, a wellhead housing adapted to be installed on a subsea well has a relatively large diameter lower bore portion and a relatively small diameter upper bore portion which provides a relatively thick wall thereabout, a casing hanger is adapted to be lowered into and landed within the lower bore portion of the wellhead housing to suspend a production casing string within the well, and a tubing hanger is adapted to be lowered into and landed within the upper bore portion of the wellhead housing in order to suspend a production tubing string within the production casing string. More particularly, the portion of the wellhead housing which surrounds the upper bore portion is sufficiently thick that passageway means may extend therein from a lower end connecting with the annulus between the casing and tubing strings and an upper end connecting with the upper end of the wellhead housing, and then with a tree or production riser thereabove, and remotely operable valve means may be installed in the passageway means to control flow between the annulus and the upper end of the wellhead housing. Moreover, additional passageway means may extend within this relatively thick wall of the housing to connect equipment above the upper end of the housing with a conduit extending through the annulus and through which control fluid may flow to control a safety valve for the tubing or other downhole function.

Tubular members known as "spools" are often installed on wellhead housings when it is decided to complete or workover the well. Among other things, they add vertical space to the wellhead. Additionally, they assist in resisting bending moments imposed on the wellhead. Normally, the spools have the same I.D. as the bore of the wellhead housing on which they are installed. In accordance with another novel aspect of the invention, the wellhead housing includes a casing head in which the lower bore portion is formed and in which the casing hanger is landed, and a spool above the casing head in which the upper bore portion is formed and in which the tubing hanger is landed above the casing hanger.

In the preferred and illustrated embodiment of the invention, a first, relatively large diameter, low pressure drilling riser is lowered onto and releasably connected to the upper end of the casing head, prior to lowering and landing of the casing hanger therein, and a second, relatively small diameter, high pressure drilling riser is lowered onto and releasably connected to the upper end of the spool, following removal of the first riser to permit lowering and landing of the casing hanger. The tubing hanger has passageways which, upon landing of the tubing hanger within the spool, are aligned for connection with passageway means in the spool through which control fluid may pass to or from a downhole function.

In accordance with one embodiment of the invention, wherein the well is to be produced through a Christmas tree at the surface, the second riser is removed and replaced by a high pressure production riser which is lowered onto and releasably connected to the upper end of the spool, upon lowering and landing of the tubing hanger therein. More particularly, the means for releasably connecting the production riser to the spool includes a connector body having passageway means for connecting the upper end of the passageway means in the spool with a conduit leading to the surface.

In accordance with an alternative embodiment of the invention, wherein the well is to produced at the subsea level, a Christmas tree is lowered onto and releasably connected to the upper end of the spool following removal of the high pressure drilling riser and landing of the tubing hanger within the spool. More particularly, the Christmas tree is connected to the spool by a connector body having passageway means therein for connecting the upper end of the spool passageway means with means a valve controlled passageway in the tree.

Figure 2A:
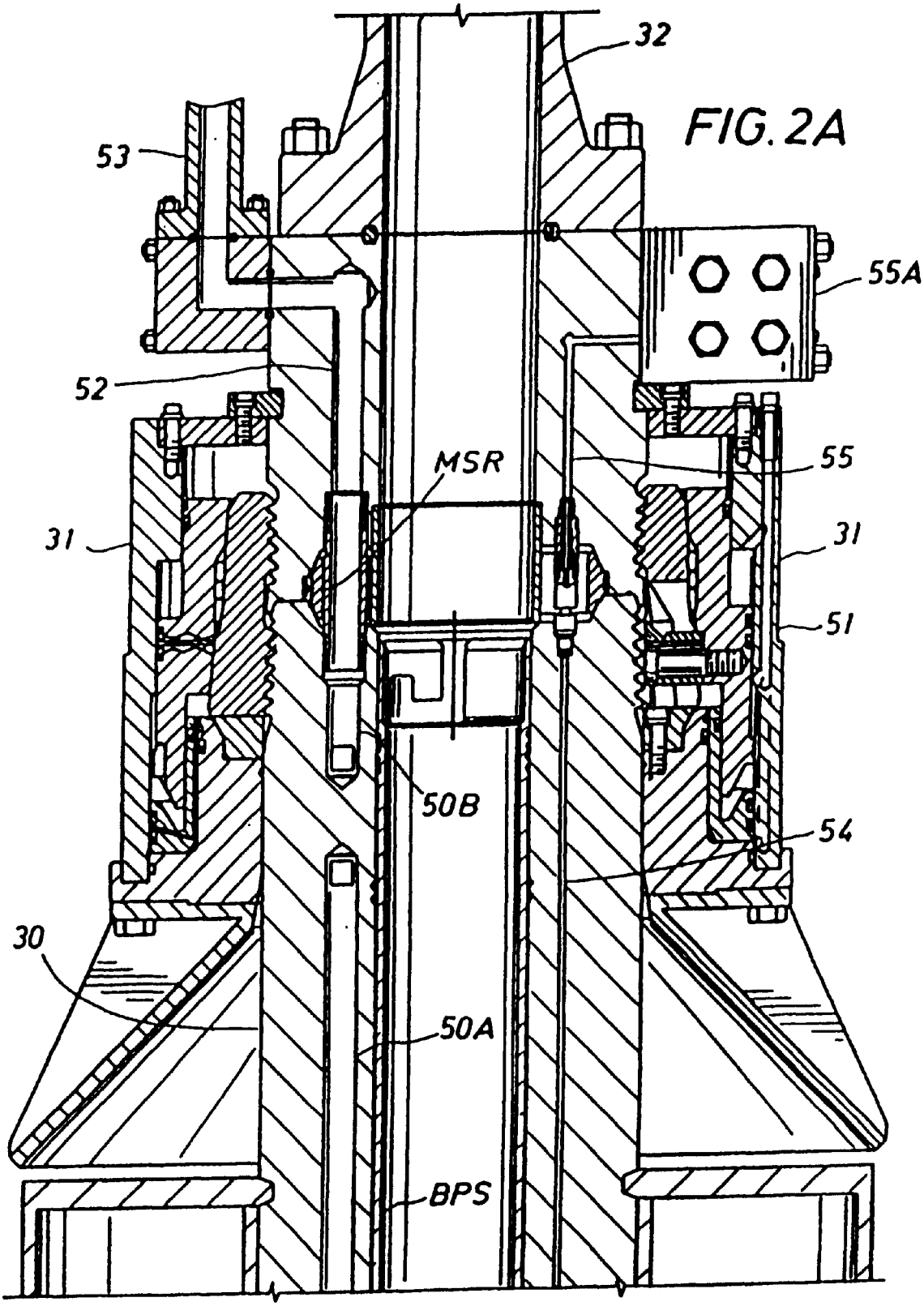
Figure 2B:
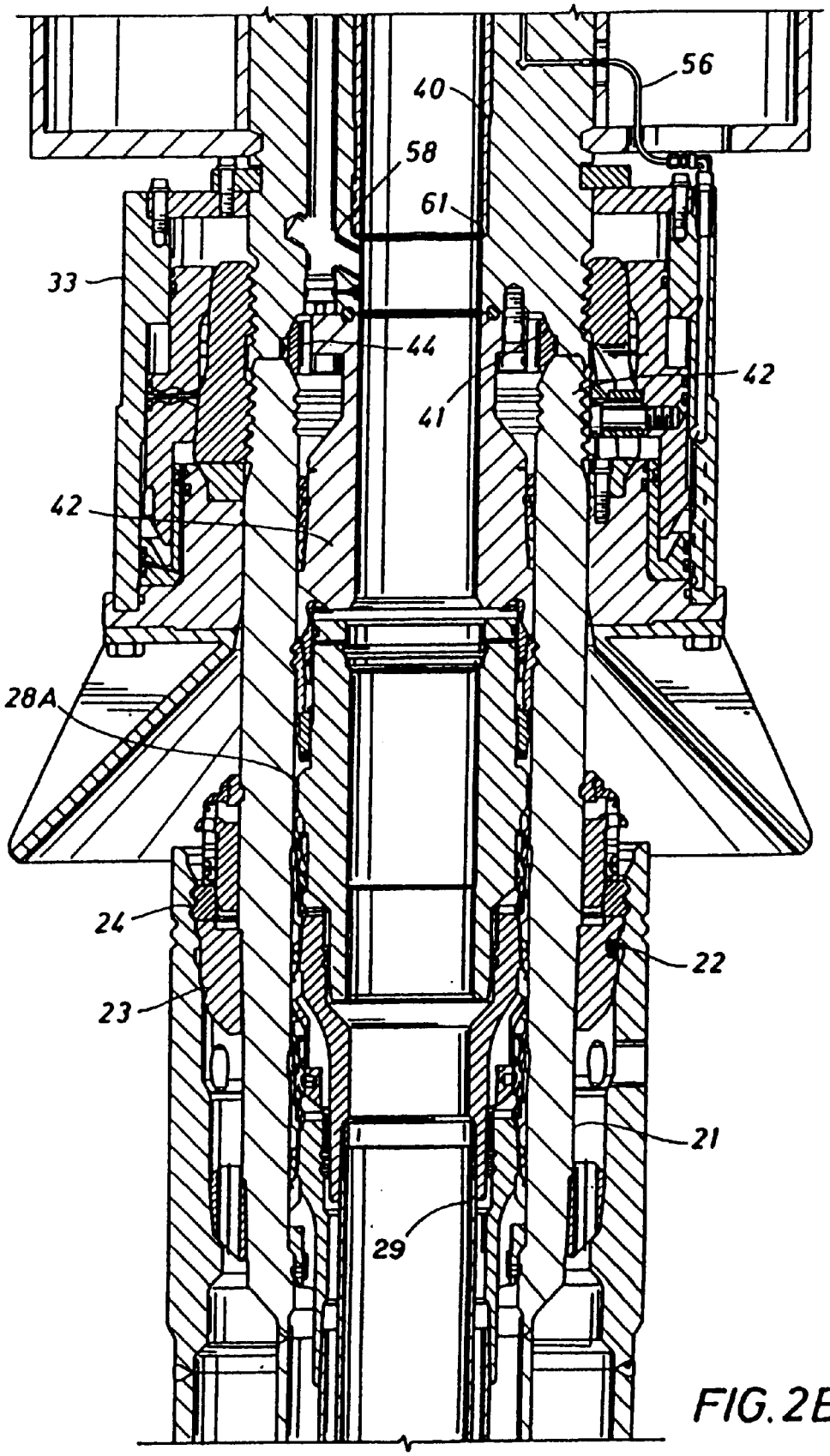
Figure 3A:
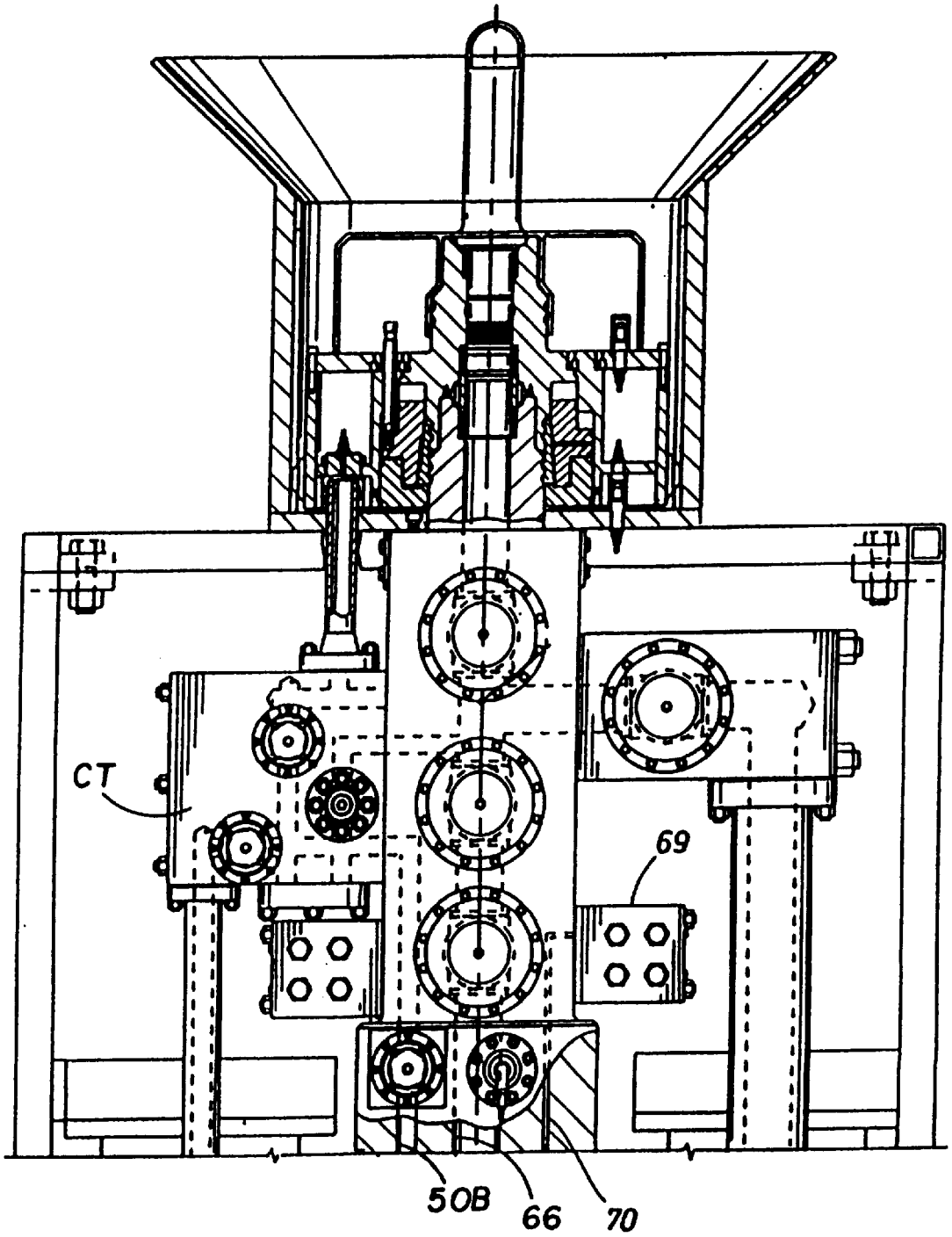
Figure 3B:
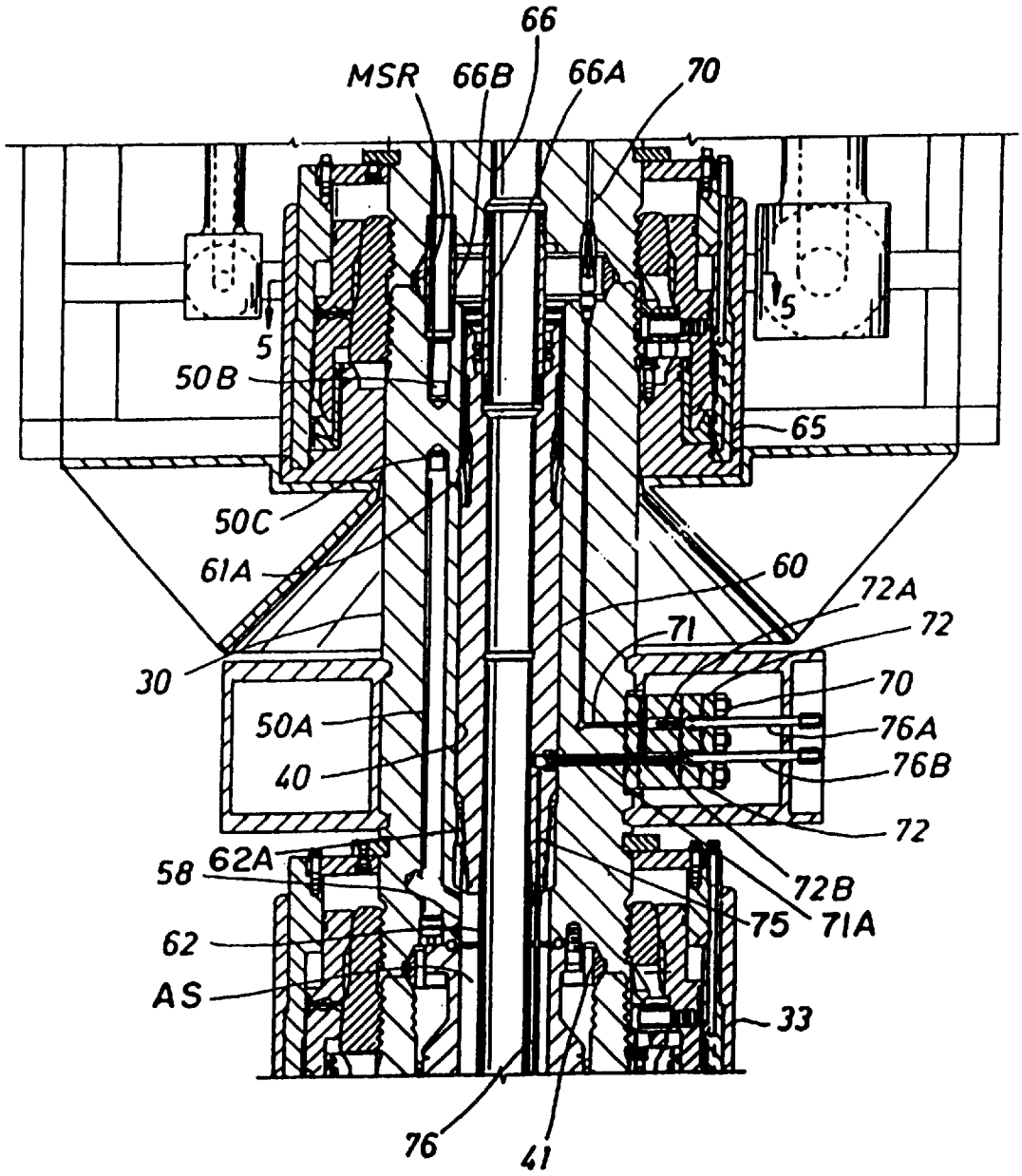
Figure 3C:
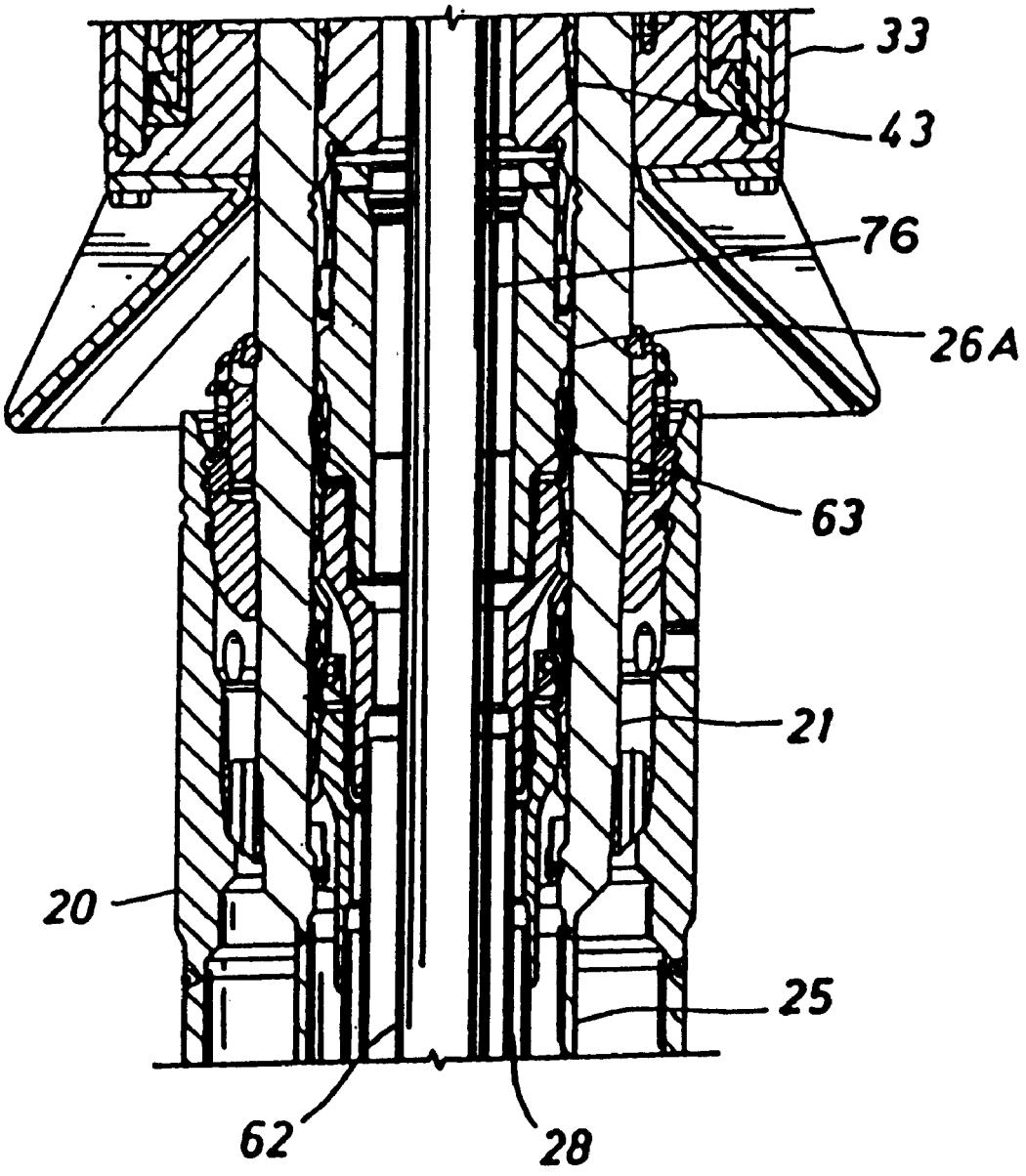
Figure 4A:
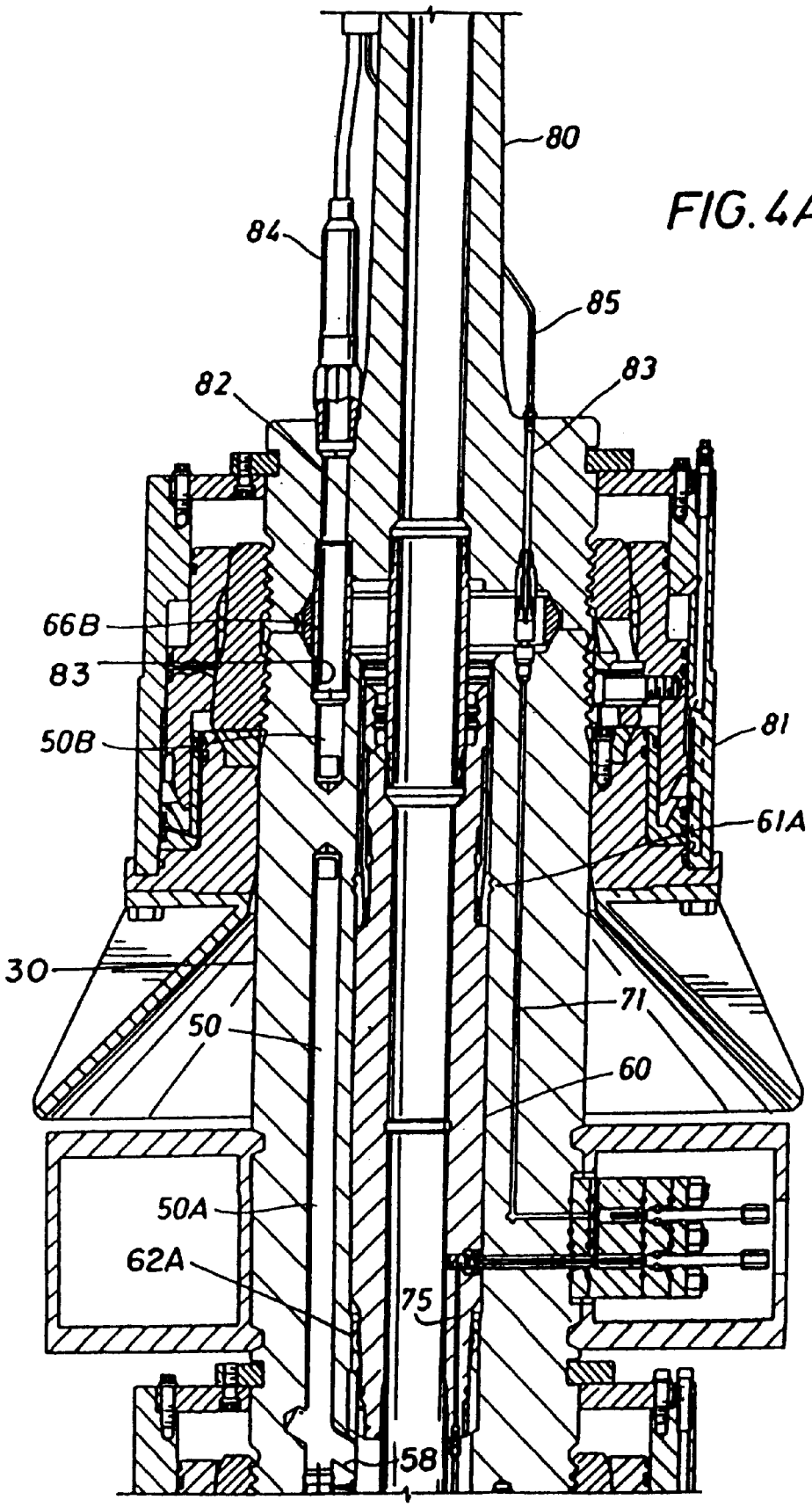
Figure 4B:
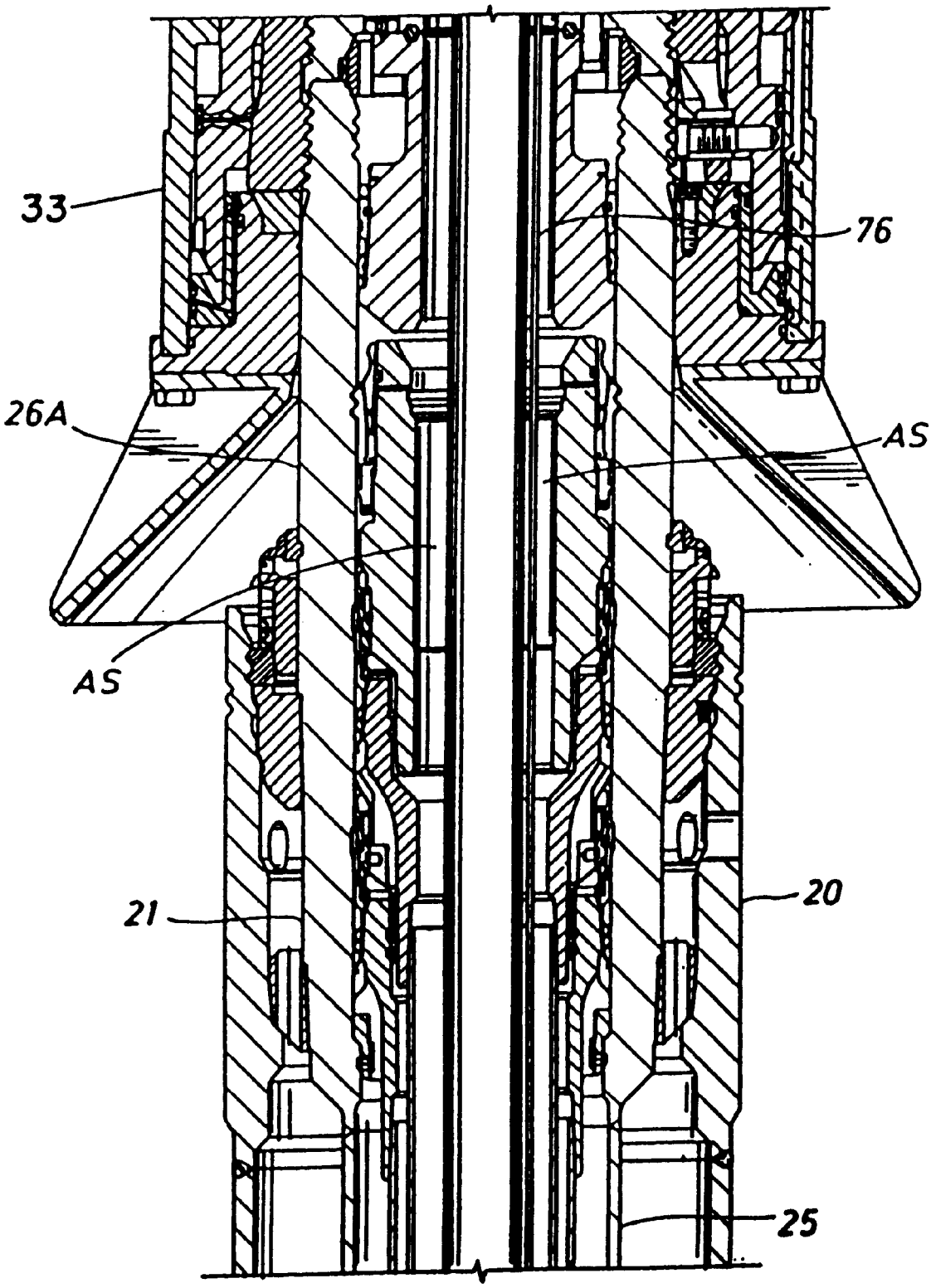
Figure 5:
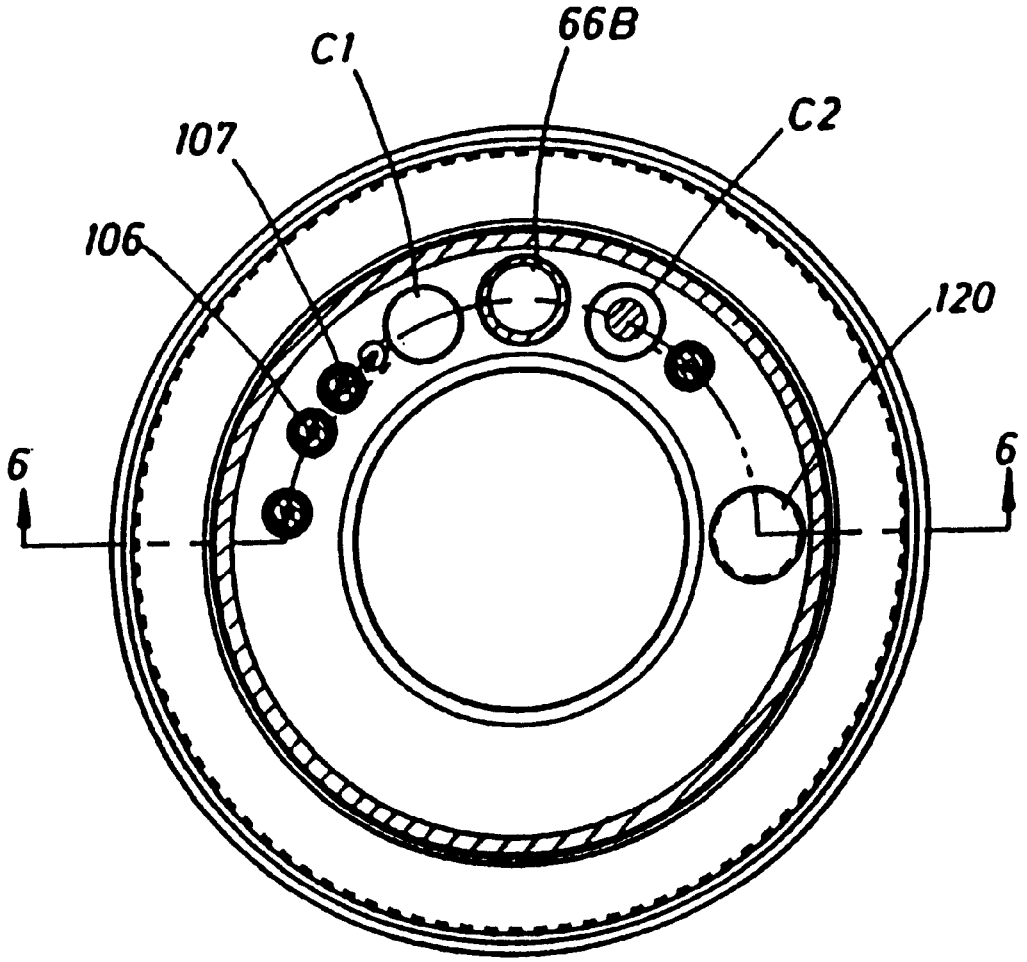
Figure 6:
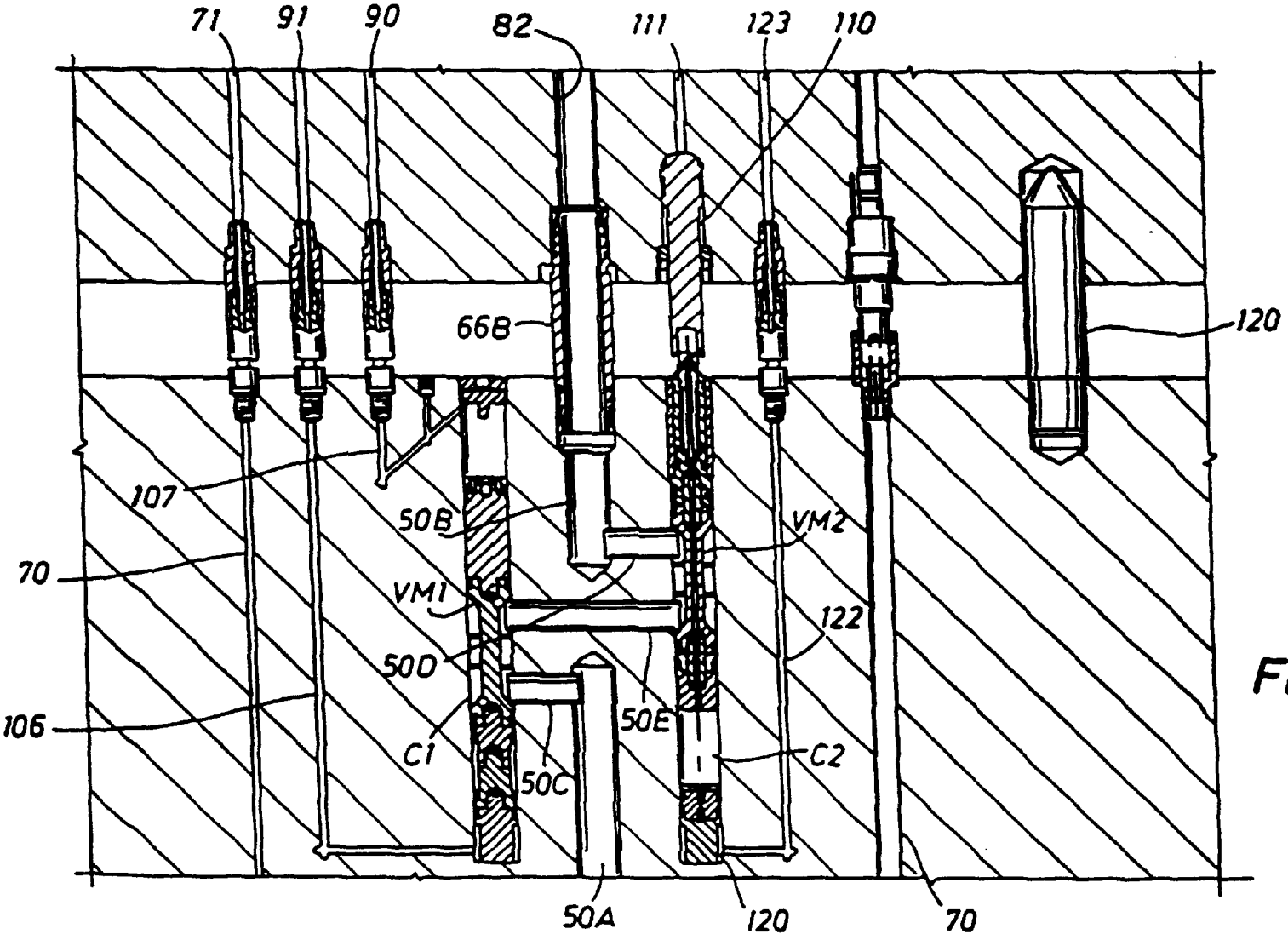

In the drawings, wherein like reference characters are used throughout to designate like parts:

FIG. 1 is a vertical sectional view of subsea drilling and completion apparatus constructed in accordance with the present invention, and showing a casing head landed within a conductor housing installed on a conductor casing at the subsea level, a casing hanger landed within the bore of the casing head to suspend a surface casing string within the conductor casing, a production casing hanger landed within the bore of the surface casing hanger to suspend a production casing string within the surface casing, and a relatively low pressure, large diameter drilling riser removably installed on the upper end of the casing head;

FIGS. 2A and 2B are of the upper and lower portions of an apparatus similar to FIG. 1, but upon removal of the drilling riser from the upper end of the casing head and lowering of a spool suspended from a high pressure production riser into landed position on the upper end of the casing head;

FIGS. 3A, 3B, and 3C are vertical sectional views of upper, intermediate, and lower portions of apparatus according to the second described embodiment of the invention, upon installation of a tubing hanger in the spool, removal of the high pressure riser of FIG. 2A from above the spool, and lowering of a Christmas tree into connection with the upper end of the spool, and showing the bore of the tubing hanger connecting with valve controlled passageways in the tree so that production may be controlled at the subsea level;

FIGS. 4A and 4B are vertical sectional views of the upper and lower ends of the apparatus according to the alternative embodiment of the invention, wherein, as in FIGS. 3A–3C, the tubing hanger has been landed in the spool, and the high pressure riser has been removed from the upper end of the spool, and a high pressure production riser has been lowered into releasable connection with the upper end of the spool to enable production from a blowout preventer at the surface;

FIG. 5 is a cross sectional view of the apparatus as seen along broken lines 5—5 of either FIGS. 3A or 4A; and FIG. 6 is a developed view of the interface between the spool and lower end of the connector at the lower end of the tree of FIG. 3A or the production riser of FIG. 4A, as seen along broken lines 6—6 of FIG. 5 and showing connections between passageways at the end faces.

With reference now to the details of the above described drawings, a conductor housing 20 is shown in FIGS. 1 to 4 to be installed on the upper end of a conductor casing extending into the wall, and to have a casing head 21 landed therein to suspend a surface casing 25 within the conductor casing. More particularly, a collar 22 about the head is locked down on a seat 23 in the housing 20 by locking parts 24 thereabove. The casing head 21 has been lowered into the conductor housing by means of a low pressure, large diameter drilling riser 26 having a connector 27 on its lower end releasably connected to the upper end of the head. Suitable drilling tools are of course lowered and raised through the spool head and riser to and from the well bore during the drilling program.

The connector 27 may be constructed in accordance with U.S. Pat. No. 4,902,044, and thus includes a normally expanded locking ring 27A which, when in its outer expanded position, permits the lower end of the riser to be lowered onto the upper end of the casing head to dispose the upper and lower locking teeth on the locking ring positions opposite grooves about the lower end of the riser and upper end of the casing head. When the riser is so landed, a cam ring 27B of the connector may be lowered to move the locking ring inwardly to the position in FIG. 1 in which it locks the lower end of the riser to the casing head, and causes a metal seal ring MSR carried on the lower end of the riser to be sealably engaged with seal surfaces on the ends of the aligned bores of the riser and casing head.

Upon landing of the riser on the casing head, a surface casing hanger 26A is lowered into and landed on a shoulder in the bore of the casing head 21 to suspend the surface casing 28 suspended therefrom within the conductor casing 25. As also shown in FIG. 1, a production casing hanger 27 is then lowered into and landed on the hanger 26A within the bore of the casing head to suspend an inner production casing 29 within the surface casing 28. As well known in the art, the production casing hanger carries an assembly for lowering into the annular space between the hanger and the bore of the production casing head to seal therebetween, as well as for locking engagement with the bore of the head for holding it down within the space.

A tubular bore protector 28A is then lowered into the bore of the casing head for landing on the upper end of the production casing hanger 27 and carries suitable mechanism for locking it within the bore of the casing head. Upon completion of the drilling program, the locking ring of the connector 27 is released to permit the low pressure riser 26 to be retrieved with the connector from the upper end of the casing head.

As shown in FIG. 2, a connector 33 on the lower end of a spool 30 is lowered into connection with the upper end of the casing head. The lower end of a high pressure, small diameter drilling riser 32 is in turn releasably connected by a connector 31 to the spool. Both connectors 31 and 33 may be generally of the same construction as one another as well as to the connector 27, connector 31 differing primarily in having passageways formed in its body to form continuations of passageway means in the spool, as will be described to follow. Thus, as shown, each connector includes a normally expanded locking ring which, when expanded, permits it to be lowered over the upper end of the casing head or the spool, as the case may be, and moved by a cam ring into the locking position shown.

The casing head 21 with the spool 30 installed thereon form a "wellhead housing" as that term is used in the claims and other portions of the written description of the present invention. More particularly, the spool has a bore 40 as well as an enlarged counterbore 41 at its lower end which, when the spool is mounted on the upper end of the casing head 21, forms an upward continuation of the relatively enlarged diameter bore through the casing head. As previously described, the wall of the upper portion of the wellhead formed by the spool is thicker than the enlarged diameter lower portion within the casing head.

The spool also has a tubular extension 42 at its lower end which extends downwardly into the upper end of the casing head bore above the bore protector 28A, and which carries means 43 about it for sealably engaging with the bore of the casing head. A metal seal ring 44 is carried on the lower end of the enlarged lower end of the bore of the spool for sealably engaging seal surfaces on the opposed ends of the bores of the head and spool when the connector 33 is moved to locked position on the casing head.

In accordance with the novel aspects of the present invention, the spool has passageway means 50 extending therein to connect at its lower end with the bore of the spool extension 42 and at its upper end with passageway means 52 within the connector 31 leading to a conduit 53 mounted on the connector body for extension along the side of the riser to connect with suitable control apparatus at the surface level.

As also shown in FIGS. 2A and 2B, another passageway means 54 extends within the spool to connect at its upper end with passageway means 55 in the body of connector 31 leading to a control housing 55A on the side of the connector body. The lower end of passageway means 54 extends laterally to connect to an external line 56 leading to a cylinder of connector 33 for operating the cam ring and thus moving the locking ring of the connector 31 between opened and closed positions in response to the supply and exhaust of a remote source of pressure fluid to and from the control housing.

The upper ends of the annulus safety valve passageway means 50 in the spool and the continuation thereof in passageway means 52 in the body of connector 31 are counterbored to receive a seal sleeve bridging the gap between them, and another seal sleeve extends downwardly from passageway means 55 of the upper connector for fluidly connecting with the upper end of the passageway means 54 in the spool. A metal seal ring MSR is carried by the lower, counterbored end of the upper connector body 31 for sealably engaging with a seal surface about a counterbore in the upper end of the spool so as to seal off between the upper end of the inner bore through the spool and the bore through the upper connector body.

As also shown in FIG. 2B, the lower end of the passageway means 50 in the spool has a lateral port 58 leading to the bore in the spool, and thus with the vertically aligned bore in the lower extension 42 of the spool. As will be described to follow, this enables the lower end of the passageway means to be connected through the extension with an annular space between the casing string 29 and a tubing string to be lowered on a tubing hanger into the well through the wellhead housing.

Following drilling of a smaller diameter bore hole in the subsea well, a bore protector sleeve BPS (FIGS. 2A and 2B) is removed from within the bore of the spool, and a tubing hanger 60 (see FIG. 3) is lowered through the high pressure drilling riser, riser connector 31, and bore 40 of the spool 30 to permit it to be landed on a shoulder 61 in the spool on which the bore protector sleeve BPS was landed. A tubing string 62 connected to the lower end of the tubing hanger is thus lowered through the production casing hanger for suspension within production casing string 28 suspended therefrom. Sealing mechanism 62A is carried about the lower end of the tubing hanger for sealing with the bore of the spool above the landing shoulder 61 and thus above port 58, and a locking mechanism 61A is carried about the hanger for locking engagement with the grooves in the bore of the spool to hold the tubing hanger down within the spool.

Upon landing, sealing, and locking of the tubing hanger in place, the upper connector 31 of FIG. 2A is released from the spool to permit it to be retrieved with the high pressure riser 23. At this time, the well may either be prepared for production at the subsea level, as illustrated and to be described in connection with FIGS. 3A–3C, or for production at the surface, as illustrated and to be described in connection with FIGS. 4A and 4B.

In the first instance, a Christmas tree CT is lowered onto and releasably connected to the upper end of the spool by means of a connector 65 similar in construction to the previously described upper connector, at least insofar as its locking mechanism for connecting to it to the upper end of the spool is concerned. The Christmas tree has a production bore 66 through which it is controlled by suitable valves in the tree, as well known in the art. A tubular member 66A extends from the counterbored lower end of the production bore into the counterbored upper end of the tubing hanger 60 to confine flow through the tubing string upwardly into the tree for producing the well at the subsea level.

A metal seal ring MSR is carried with a counterbore in the lower end of the connector body for sealably engaging the seal surface on the upper end of the spool 30, again as described in connection with the upper connector in FIG. 2. An additional seal sleeve 66B is carried by the lower end of the counterbore of a passageway 50B the Christmas tree connector within seal ring MSR for sealably engaging the counterbored upper end 50B of the annulus valve passageway means 50, similarly to connection of passageway means 52 of connector 31 of FIG. 2A.

The sealing mechanism 62A about the lower end of the tubing hanger sealably engages the bore through the spool above the lateral port 58 in the lower end of the passageway means 50 in the spool, and thus with the annular space AS between the bores of the lower end of the spool and its lower extension and the bore through the bore protector above production casing hanger as well as the bore of the hanger 60 itself, and thus with the lower end of the annulus within the wall between the casing and tubing strings.

As shown in FIGS. 3A and 3B, control pressure is supplied from a housing 69 on the side of the tree through passageway means 70 in the connector body at the lower end of the tree into passageway means 71 in the spool to one side of the passageway means 54 of FIGS. 2A and 2B. A lateral leg of passageway means 71 connects with manifolding in a penetrator housing 72 mounted on the side of the spool, and, thus, with the outer diameter of the spool 30.

The penetrator housing manifolding includes upper and lower passageways 72A and 72B connecting with one another and with the lateral leg of spool passageway 71 and a lower spool passageway 71 A connecting its inner and outer diameters respectively. The lower lateral passageway 72B is aligned with the spool passageway 71A which leads to the upper lateral leg of passageway means 75 means in the tubing hanger. The lower end of passageway means 75 in turn connects with a control line 76 extending through the tubing/casing annulus AS to a downhole function (not shown), such as a tubing safety valve, to be controlled within the well.

The connection of penetrator passageway 72A with passageway 72B may be opened and closed by an upper stem 76A extending from the penetrator, and a valve within the lateral upper end of the passageway means 75 may be opened and closed by a lower stem 76B in the lower penetrator passageway 72B. The outer ends of the stems are positioned for manipulation by a ROV landed on the frame.

With references now to FIGS. 4A and 4B, in the event the well is to be produced through a BOP (not shown) at the surface level, and upon retrieval of the high pressure drilling riser 52 with its connector, as described in connection with FIGS. 3A–3C, a high pressure, production riser 80 connected at its upper end to the BOP at the surface, and having a connector 81 similar to those previously described, at its lower end, is lowered into releasable connection with the upper end of the spools. Like the connector at the lower end of the Christmas tree of FIG. 3, the connector 81 has a lower counterbore from which seal sleeves extend for fluidly connecting passageways 82 and 83 therein with the upper end 50B of the passageway means 50 in the spool, and connecting with the control line passageway means 71 in the spool which connects at its lower end with the manifold in the penetrator housing, and thus through the tubing hanger 60, with control conduit 76 extending through the annulus for connection with a downhole function. The upper end of the passageway 82 in the connector body connects with an external conduit 84 adapted to extend along the side of the production riser 82 to the surface preventer, and the upper end of the control line passageway 83 in the preventer body connects with a control line 85 adapted to extend upwardly along the production riser to a source of control fluid.

The annulus safety valve for controlling flow within the passageway means 50 in the spool is shown in FIGS. 5 and 6 to be similar in many respects to that shown in FIGS. 9 to 12 of the above mentioned U.S. Pat. No. 5,687,794, except that, in accordance with the novel aspects of the present invention, it is formed in the spool 30 rather than in the a hanger. Thus, as also previously described, and as best shown in FIGS. 5 and 6, this passageway means includes a lower portion 50A connecting at the lower end with the port 58 leading to the bore of the spool and then to the tubing/casing annulus, and an upper portion 50B connecting at its upper end with the seal sleeve 66B connecting with passageway means 82 in the lower end of a connector body, which may be on the subsea Christmas tree (FIG. 3A) or the lower end of the production riser (FIG. 4A).

As best shown in FIG. 6, the upper end of the passageway portion 50A connects with a lateral passageway portion 50C leading to a cavity C1 in which a first valve member VM1 is disposed. The lower end of the upper passageway portion 50B connects with another lateral passageway portion 50D leading to a cavity C2 in which a second valve member VM2 is disposed. These cavities are in turn connected by an intermediate lateral passageway portions 50E so that, as will be described below, and, as in U.S. Pat. No. 5,687,794, the valves are connected in series.

More particularly, the first valve is primary in that it provides the basic function of closing the passageway means 50 in response to a predetermined condition in the well, and the second valve is an emergency or secondary valve in that it provides a backup to close the primary valve in the event the primary malfunctions and does not close for some reason. It will be understood, however, that the annulus valve may of a simpler construction including only a single valve, as shown, for example, in U.S. Pat. No. 5,143,158, the important thing being that regardless of the details, the valving mechanism is disposed at least partly in the passageway means in the spool.

With reference now to the details of FIGS. 5 and 6, the primary valve member VM1 is sealably slidable within the cavity C1 which opens to the upper end of the spool and is adapted to be closed by a removable plug. The primary valve member has a reduced diameter portion intermediate upper end lower seals thereabout, so that, in its lower position shown in FIG. 6, it connects passageway portions 50C and 50E to permit flow past it. When valve VM1 is raised, however, its lower seals cover these lateral passageway portions 50C and 50E to prevent flow between the lower passageway portion 50A and into the primary valve.

The emergency valve member VM2 is reciprocable within cavity C2 which also opens to the upper end of the counterbore in the upper end of the spool. This valve member also has a reduced diameter portion intermediate upper and lower seals to permit flow between the lateral passageway portions 50D and 50E, when in its upper position shown, but to prevent such flow when it is lowered to dispose its upper seal over the lateral passageway portions. As previously described, a seal sleeve 66B is received at opposite ends within the upper end of the passageway portion 50B and the lower end of previously described passageway 82 in the connector body of the Christmas tree or the lower end of the production riser.

As shown in FIG. 6, the primary valve member is moved to and held down in its open position by means of operating fluid supplied to its upper end beneath an upper plug through a sleeve connecting passageway means 107 and 90 is the counterbores in the spool and connector body, respectively, with a source of pressure fluid to which the passageway in the connector body is connected. The primary valve member VM1 may be moved upwardly to its closed position by the supply of operating fluid from the same or another source through another passageway 91 in the connector body connecting with passageway 106 in the spool connecting with the lower end of cavity C1. Thus, operating fluid is exhausted from the passageway 107 as it is supplied to the passageway 106, and, conversely, when the primary valve member is to be lowered to its open position, operating fluid is exhausted from the passageway 106 as it is supplied to the passageway 107.

As previously described, the secondary or emergency valve is adapted to be closed in the event the primary valve fails to close under the predetermined conditions of closure of the annulus safety valve. For this purpose, the cavity C2 which opens to the space formed between the counterbores in the lower end of the connector body and upper end of the spool permits the upper end of the secondary valve member VM2 to be engaged by a plunger 110 sealably slidable within a cavity in the lower end of the connector body. Thus, pressure fluid from a suitable source may be supplied to the upper end of the plunger through a passageway 111 in the connector body so as to lower the plunger as well as the valve member VM2 to a position in which the upper seals thereabout close both lateral passageways.

When it is desired to return the emergency valve member VM2 to its upper open position, as shown in FIG. 6, pressure fluid is supplied from a source leading to passageway 123 in the connector body through passageway 122 in the spool through the cavity C2 beneath seals about a plug 120 beneath the emergency valve member VM2, thus causing it to rise and raise the valve member VM2 as well as the plunger 110 upwardly to the position shown in FIG. 6. This of course is accomplished as pressure fluid is exhausted from the upper end of the plunger through passageway 111.

Conversely, when the secondary valve is to be returned to its open position, pressure is supplied to the upper end of the plunger and exhausted from the lower end of the plug 120. In its lower position, the plug forms a stop to downward movement of the emergency spool member. The spool forming the secondary valve member VM2 also has a hole through it in order to balance pressure above and below it.

As described in the aforementioned figures of U.S. Pat. No. 5,687,794, the primary and emergency valves are adapted to be operated independently of one another. Consequently, under normal conditions, there would be no need to operate the emergency valve, thus causing it to remain in its open position, as shown in FIG. 6, to permit flow through the passageway means 50 to be controlled by the primary valve. Nevertheless, as described in the aforementioned patent, in the event of a malfunction of some type of the primary valve, the secondary or emergency valve may be closed by moving the second valve member VM2 thereof to its closed position.

The upper end of the control passageway 70 in the spool connecting with a subsurface safety valve in the tubing, or other function to be controlled within the well, is also shown in the developed view of FIG. 6 along with the sleeve connecting it to the control line passageway 71 in the connector body, which is shown intermediate the cavity of the primary valve and the cavity of the secondary valve, with the sleeve 66B between the portions of the control lines in the connector and spool for the secondary valve being shown to the right of the emergency valve bore. FIGS. 5 and 6 also show a pin 120 carried by the spool and having its upper end received in a cavity in the lower end of the connector for aligning the connector and thus its tubular extensions for alignment with the openings in which they are to be received as the connector is lowered onto the spool.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Subsea drilling and completion apparatus comprising a wellhead including a casing head adapted to be installed on a subsea well and a bore therethrough a casing hanger adapted to be lowered into and landed within the bore of the head to suspend a casing string within the well, a spool body having a bore therethrough and adapted to be lowered onto and connected to the upper end of the casing head, following landing of the casing hanger, the bore of the spool body being smaller than that of the casing head and having a wall thickness thereabout greater than the wall thickness of the casing head about its bore, a tubing hanger adapted to be lowered into and landed in the bore of the spool in order to suspend a tubing string within the casing string, the wall of the spool having passageway means therein which connects the annulus between the casing and tubing strings with the top surface of the upper end of the spool body, and, means in the spool body for opening and closing the passageway means.

2. As in claim 1, further comprising a first large diameter, low pressure drilling riser through which the casing hanger may pass, means by which the lower end of the first riser may be lowered into and releasably connected to the upper end of the casing head, prior to landing of the casing hanger therein, a second smaller diameter, high pressure drilling riser through which the tubing hanger may pass, means by which the lower end of the second riser may be lowered into releasable connection with the upper end of the spool, following removal of the first riser and lowering and landing of the casing hanger, and having passageway means forming a continuation of the passageway means of the top surface of the spool.

3. As in claim 2, including a high pressure production riser, and means by which the lower end of the production riser may be lowered onto and releasably connected to the upper end of the spool, following removal of second riser through which the tubing hanger was lowered and landed, so as to form a continuation of the bore of tubing hanger.

4. As in claim 2, including a Christmas tree, means by which the lower end of the tree may be lowered onto and releasably connected to the upper end of the spool, following removal of the second drilling riser and landing of the tubing hanger with the spool, said tree having a valve controlled passageway which forms a continuation of the bore of the tubing hanger, and passageway means forming an upward continuation of the passageway means in the top surface of the spool.

5. As in claim 4, wherein each of the tree and the means for connecting it to the spool having passageways for forming a continuation of the upper end of the spool passageway means.

6. As in claim 2, wherein the spool has a second passageway means connecting the upper end of the spool with its outer side and third passageway means connecting its outer side with its bore, the tubing hanger was a passageway connecting its outer side in fluid communication with the upper end of the third spool passageway means with a control line extending downwardly therefrom within the annulus, the connector has a passageway forming an upward continuation of the upper end of the second spool passageway means for connecting with a conduit extending to a Christmas tree at the surface, and means are mounted on the spool to control flow between the second and third spool passageway means and, upon landing of the tubing hanger, between the third passageway means and the tubing hanger passageway.

7. As in claim 1, including a tubular member on the lower end of the spool forming a continuation of its bore and extending into the bore of the casing head for sealing therewith above the casing hanger and forming an annulus between its bore and the tubing string to connect the lower end of the passageway means in the spool with the tubing casing annulus.

8. As in claim 1, wherein the means for opening and closing the passageway means is remotely operable valve.

9. As in claim 8, wherein the remotely operably valve is responsive to a predetermined condition in the well.

* * * * *